US006811284B2

(12) United States Patent
Hyvarinen et al.

(10) Patent No.: US 6,811,284 B2
(45) Date of Patent: Nov. 2, 2004

(54) METHOD AND DEVICE FOR MODIFYING THE IRRADIANCE DISTRIBUTION OF A RADIATION SOURCE

(75) Inventors: Jaakko Hyvarinen, Espoo (FI); Folke Stenman, Helsinki (FI)

(73) Assignee: Endeas Oy, Espoo (FI)

( * ) Notice: Subject to any disclaimer, the term of this patent is extended or adjusted under 35 U.S.C. 154(b) by 0 days.

(21) Appl. No.: 09/842,767

(22) Filed: Apr. 27, 2001

(65) Prior Publication Data

US 2002/0138214 A1 Sep. 26, 2002

(30) Foreign Application Priority Data

Apr. 28, 2000 (FI) ..... 20001010

(51) Int. Cl.[7] ..... F21S 2/00

(52) U.S. Cl. ..... 362/257; 362/260; 362/296; 362/298; 362/300; 362/310; 362/16; 362/18; 362/311; 362/360; 362/351; 362/1; 362/2; 362/557

(58) Field of Search ..... 362/257, 260, 362/296, 298, 300, 310, 16, 18, 311, 360, 1, 2, 557, 2.57, 2.6, 351, 268; 355/37

(56) References Cited

U.S. PATENT DOCUMENTS 4,099,864 A * 7/1978 Gilligan et al. ..... 355/37
5,041,952 A * 8/1991 Janda et al. ..... 362/183

FOREIGN PATENT DOCUMENTS

DE A3-910520 10/1990

* cited by examiner

*Primary Examiner*—Stephen Husar
*Assistant Examiner*—B. Zeade
(74) *Attorney, Agent, or Firm*—Birch, Stewart, Kolasch & Birch, LLP

(57) ABSTRACT

The invention is related to a method and apparatus for modifying the irradiation distribution of a radiation source. In accordance with the method the radiation source (1) is used to direct radiation to an essentially planar target surface (6). In accordance with the invention between the radiation source (1) and the target surface (6), several plates (4), which are essentially transparent to the radiation and have spaces between them, are placed close to the radiation source (1), in order to use the reflection and absorption of the transparent plates (4) to attenuate the radiation to desired areas.

14 Claims, 3 Drawing Sheets

METHOD AND DEVICE FOR MODIFYING THE IRRADIANCE DISTRIBUTION OF A RADIATION SOURCE

The invention relates to a method for modifying the irradiance distribution of a radiation source according to the preamble of claim 1.

The invention also relates to a device for modifying the irradiance distribution of a radiation source.

Especially one of the preferred embodiments of the invention relates to evening the irradiance distribution of a radiation source on a large planar target surface.

In many applications, especially in photographic exposure and heating applications, the uniform illumination of a large plane is a highly desirable and even a necessary feature. For example, the irradiation intensity from an isotropic point source falling on a planar surface follows the formula $$I=I_0\cos^3(\theta) \quad (1)$$

where θ is the angle of incidence of the illumination with the plane and $I_0$ irradiance on the symmetry axis of the circular illumination pattern while, to achieve a deviation of intensity of less than ±5% over a 1.6-m diameter plane area, the point source must placed at a distance of 4.3 m. The corresponding formula for a Lambertian surface light source is $$I=I_0\cos^4(\theta) \quad (2)$$

the distance for the same intensity deviation being 5.0 m. In practice, the lamp itself can be approximated with the point-source formula and the lamp reflector with the Lambertian surface light-source formula.

Traditionally, uniform illumination has been created, e.g., by means of an array of light sources, using a carefully designed reflector behind the light source (e.g. U.S. Pat. Nos. 3,763,348 and 4,027,151), by means of a carefully designed lens system between the light source and the plane (e.g. U.S. Pat. No. 5,555,190), and also by scanning the plane with the light source.

In many applications, the use of an array of light sources incorporating plane-to-plane illumination systems is too cumbersome, expensive, and power consuming. The main shortcoming of even very carefully designed back reflectors is that the illumination distribution created is very sensitive to the dimensions of the light source and reflector and especially to the position of the light source in relation to the reflector. This also applies to the use of carefully designed lens systems, such lens systems being, in addition, far too expensive in many applications. The scanning method is suitable only for a limited number of applications and a complex mechanism is required to perform the scanning operation.

The present invention is intended to overcome the drawbacks of the techniques described above and to achieve an entirely novel type of method and device for modifying the power distribution of a radiation source.

The invention's goal is achieved by using a combination of non-absorbing and/or absorbing plates to attenuate the irradiation of areas close to the optical axis by reflecting back and/or absorbing the incident radiation in that region and, additionally, to use an optional diffuser plate to diffuse incident light from the light source and to redirect light reflected back from the plate stack onto the diffuser into a wider angular distribution More specifically, the method according to the invention is characterized by what is stated in the characterizing part of claim 1 and the device by what is stated in the characterizing part of claim 6.

The invention offers significant benefits.

Compared to the prior art, the invention permits a substantial reduction in the distance between the light source and the plane to be illuminated. This feature particularly permits smaller solar panel testing devices, bringing considerable savings in space utilization. Especially when mainly transparent elements are used to equalize the light pattern, losses of light energy are minimal. In addition, the shorter distance between the light source and the target area allows the use of light sources of lower energy.

In the following, the invention will be examined in greater detail by means of exemplifying embodiments, with reference to the accompanying drawings, in which.

In the following, the explanation of the basic idea of the invention uses a theoretical model of a point source, with no reflector behind the source. Additional remarks are made concerning the aspects to be considered and included, when designing a practical system.

The present invention employs a suitable combination of purely reflecting plates and partially absorbing plates placed between the light source and the plane. These plates are dimensioned to reflect back and/or attenuate from the light source/diffuser combination selectively as a function of direction. For example, iron-free soda glass and polycarbonate are suitable materials for constructing these plates. In air, a single glass plate will reflect 8% of the incoming light and a polycarbonate plate 10%. When using a point source, the plates must be of circular shape and be placed centrally and perpendicularly on the same axis, which comes from the light source. The plates can be placed at any distance from each other to modify the irradiance, but since the same goal can be achieved by adjusting the diameter and thickness of the plates, they are in practice placed close to each other. To ensure reflection at every surface, a small air gap must be left between the plates. If plates of non-uniform thickness are used, the distance of the plate stack and the maximum diameter of the largest plate are determined by the fact that light with a high angle of incidence must not be totally reflected. In the case of glass and polycarbonate, the angle at which total reflection occurs is about 45°. The plates can, for instance, be curved at the edges, to decrease the angle of incidence. The total number and the diameters of the plates are determined by considering the requirement for uniform irradiation of the place and the need to attenuate the irradiation density given by formulas (1) and (2). Using the theoretical point-source approach and glass plates, there will be a step of 8% in irradiation intensity step at the plane surface due to the edge of a single plate. In a real system, the light source is of finite size, which must be separately taken into account. A consequence of this is that the steps in intensity are smoothed, due to the fact that the light source becomes gradually "visible" behind the edges of the plates. For example, when using a point source, the irradiation on a plane, at an angle of incidence of 45°, is only 35% of the intensity at the angle of 0°. Twelve glass plates with diameters defined using formula (1) will smooth the minimum variation of the plane illumination to below 9%. If polycarbonate plates are used, a minimum illumination variation of 10% can be achieved with nine plates.

Figure 1:
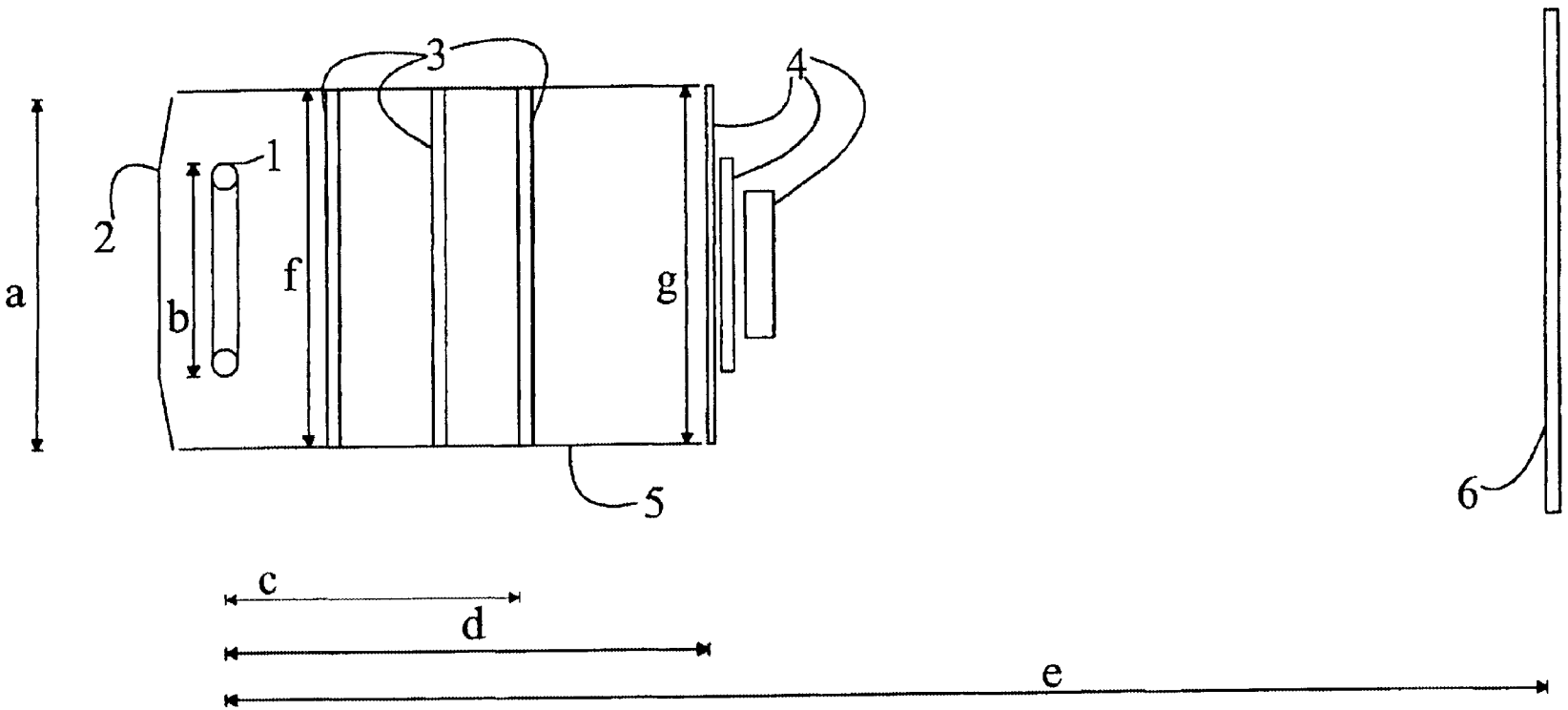
FIG. 1 is a sectional side view of a device according to the invention.

FIG. 1 shows a typical device according to the invention, comprising a light source, in this case a circular discharge tube 1, behind which a reflector 2 is positioned. In the Figure, the intensity of the light source is therefore directed to the right, towards the target plane 6, which is in this case a solar panel 6. Diffusers 3 are positioned closest to discharge tube 1, and are intended to even the intensity of discharge tube 1 in the near field. A diffuser tube 5 surrounds diffusers 3. The use of diffusers is optional in connection with this invention. Radiation passing through the final (rightmost) diffuser 3 advances to the transparent and absorbing, reflecting plates 4, which are spaced apart from each other to ensure reflection from each surface separately. The shape of the reflecting plates 4 (viewed, e.g., from the target plane 6) depends on the shape of the light source. In the case of a theoretical point source of light, plates 4 would be circular. In the case of an elongated source, for instance, the plates would be oval, with the exact shape determined by the specific geometry of the arrangement.

Diffusers 3 may be necessary, especially in the case of a light source not possessing rotational symmetry. The geometry of reflector 2 might even obviate the need for diffusers 3, to convert a non-rotationally symmetrical distribution from the discharge tube 1/reflector 2 unit into a rotationally symmetrical distribution.

A rotationally symmetrical irradiance distribution can be modified in any desired way with the aid of plates 4 stacked in a conical form. In this case, the term conical form refers to the form of the cross-section of the stack of plates 4. In accordance with FIG. 1 the largest plate of this stack is closest to the source 1, but in accordance with the invention the mutual order of the plates in the stack can be chosen freely according to optical or constructional demands. Also, in principle, the absorber stack can be replaced by a single absorbing plate of variable thickness.

The relational dimensions in one embodiment of the invention are the following:

a: diameter of the reflector 2
b: diameter of the light source 1
c: distance between the source 1 and the last diffuser 3
d: distance between the source 1 and the first plate 4
e: distance between the source 1 and the target 6
f: diameter of the diffuser 3
g: diameter of the largest plate 4 c essentially smaller than a
d less than 50% of e, typically 5–20% of e, most typically about 10% of e
f larger than b, typically smaller than 2*a*
g larger than b, typically smaller than 2*a*

The following is a description of one implementation of the invention, which is a slightly modified version of the solution of FIG. 1. This example differs from FIG. 1 mainly in that there are only two diffusers.

The diameter of reflector 2 is 150 mm. Circular tube 1 has an outer diameter of 70 mm and a thickness (tube diameter) of 10 mm, the distance between discharge tube 1 and reflector 2 being 20 mm. Diffuser tube 5 has an internal diameter of 150 mm and a matte white inner surface. The distance between discharge tube 1 and the closest diffuser 3 is 30 mm, the distance between the second closest diffuser 3 and discharge tube 1 being 50 mm (only two diffusers). Diffuser tube 5 terminates at the second diffuser (thus differing from the solution in FIG. 1). The distance of between discharge tube 1 and absorbing plates 4 is 220 mm. The material for plates 4 is Schott NG12 but any material of adequate absorption can be used. Plates 4 have the following dimensions (the first plate is that closest to discharge tube 1):

$1^{st}$ plate: diameter 150 mm, thickness 1.5 mm
$2^{nd}$ plate: diameter 100 mm, thickness 2.0 mm
$3^{rd}$ plate: diameter 70 mm, thickness 3.0 mm The gap between the plates 4 is about 0.5 mm.

In an experimental measurement, the system specified above was positioned to create a distance of 240 cm between discharge tube 1 and target area 6. A circular region of diameter 180 cm, in the target area was studied. The device creates a symmetrical circular pattern, with the highest irradiance in the centre. Without the reflecting and absorbing plates 4, the difference in illumination between the centre and the edge area of the test circle was about 35%, but was reduced to 6% when reflecting and absorbing plates 4 were used.

Obviously, the dimensioning of the device, and particularly of plates 4 depends greatly on the geometry of discharge tube 1. As a general rule, however, the stack of plates 4 should be positioned so that the closer discharge tube 1 is to target plane 6, the stronger absorption should be used for rays moving close to the optical axis, to attenuate the light in the areas that receive the greatest intensities by the laws of physics (Formulas 1 and 2).

In this application, the source of radiation source can be of any kind, such as a flashgun, light bulb, or infrared source. However, especially advantageous solutions were found in connection with flashguns created to test solar panels. The radiation source may emit either continuous or pulsed radiation.

In connection with the present invention the stack of plates 4 may absorb the radiation up to 75% of the total radiation, however, typical maximum absorption of the stack is 5–40% of the incident radiation.

In connection with the present invention by term transparent means any material being essentially non-diffusing and having absorption less than 75%.

Figure 2:
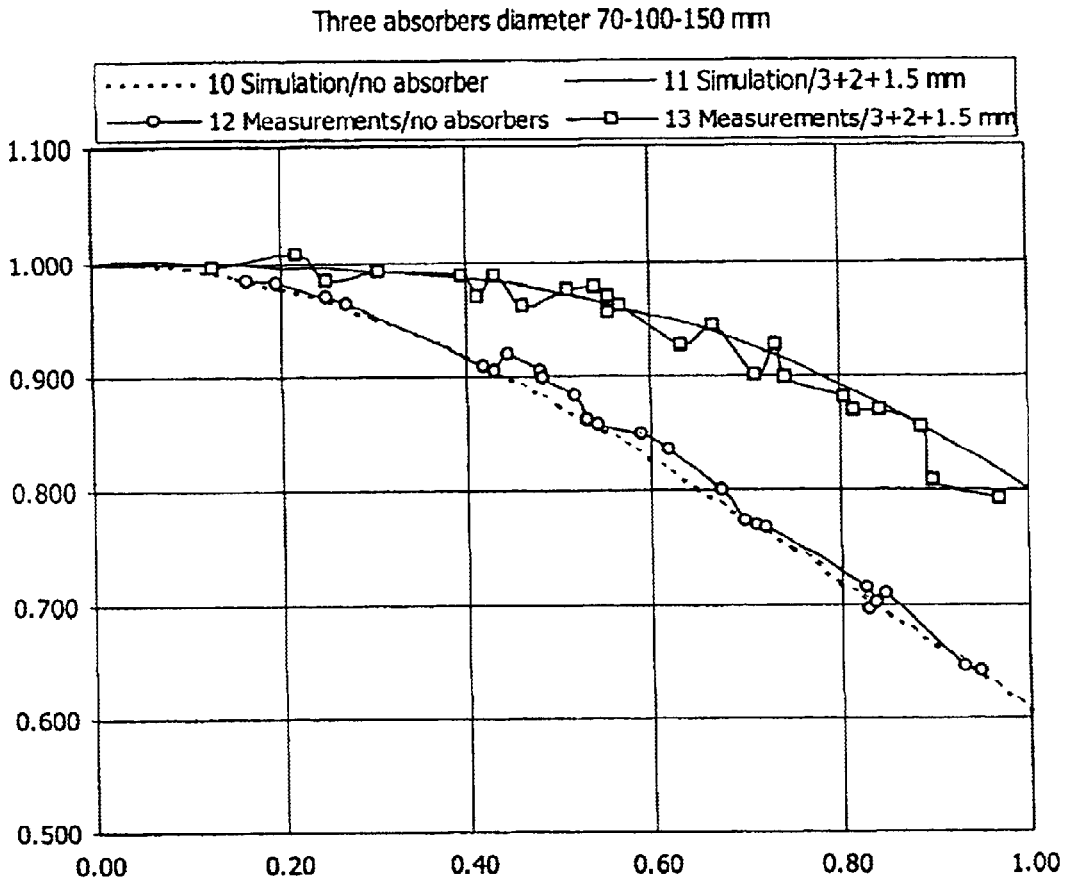
FIG. 2 is a graph showing the irradiation distribution according to one embodiment of the invention; in which is shown relative irradiance from the light source without absorbers and using three absorbers.

In FIG. 2 is shown a graph in which on the horizontal axis is shown the distance (in meters) from the centre of the target plane and on the vertical axis is shown the attenuation of the of the radiation on the target plane. In FIG. 2 line 10 represents a computer simulation with no absorbers, line 11 simulation with absorbing plates with diameters/thickness of 70 mm/3 mm, 100 mm/2 mm and 150 mm/1.5 mm. Line 12 represents measurements corresponding line 10 and line 13 measurements corresponding line 11 respectively. It is clearly brought out in the figure form the simulated irradiance curves as compared to the measured ones that the action of the invention is accurately represented by simple physical models related to the angular distribution of radiation diffused by the diffuser plates.

In accordance with the invention the mutual order of the plates 4 can be freely chosen. Also the distance of the plates 4 from the source 1 as well as their diameters can be changed.

Figure 3:
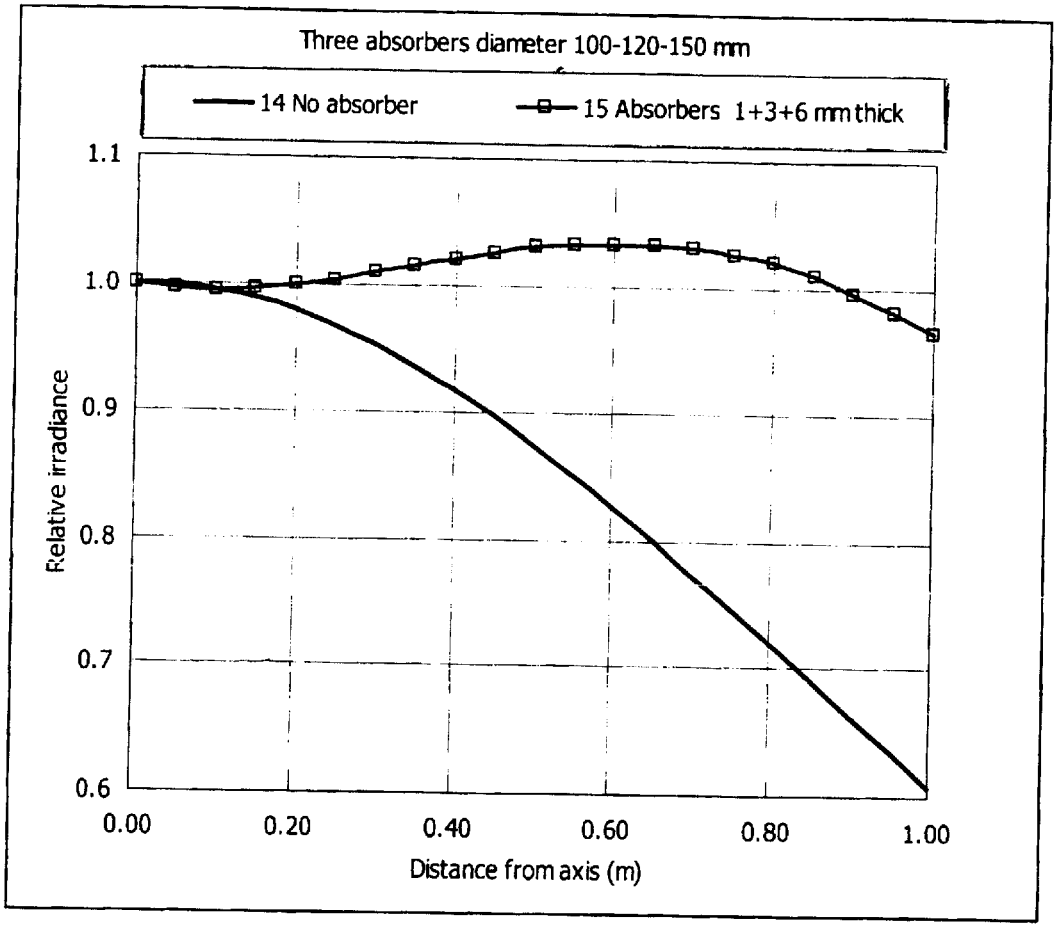
FIG. 3 is a graph showing the irradiation distribution according to second embodiment of the invention.

In FIG. 3 is shown a graph in which on the horizontal axis is shown the distance (in meters) from the centre of the target plane 6 and on the vertical axis is shown the attenuation of the of the radiation on the target plane. In FIG. 3 three additional plates to the embodiment of FIG. 2 are used, which plates are the following (diameter/thickness): 100 mm/1 mm, 120 mm/3 mm, 150 mm/6 mm. Line 14 represents a simulation using no absorbers, line 15 simulation with absorbing plates of diameter/thickness of 100/1 mm, 120/3 mm, 150/6 mm.

As is evident from the figure, the use of thicker absorbers now smoothes the irradiance to within +/−2% in the region 0–900 mm from the axis. However, according to the general properties of the invention, virtually any type of irradiance distribution can be synthesised by using appropriate combinations of plate diameters and thickness. In particular it should be noted that the desired attenuation as a function of direction can be achieved using an appropriate combination of completely transparent and/or partially absorbing plates, as each separate surface attenuates the radiation through reflection regardless of whether the plate material absorbs light or not.

It should also be noted that varying the shape of the plates in the stack makes it possible to achieve any desired symmetry properties of the irradiance distribution.

What is claimed is:

1. A method for modifying the irradiation distribution of a radiation source, comprising the steps of using the radiation source to direct radiation to an essentially planar target surface, wherein, between the radiation source and the target surface, several plates, which are essentially transparent to the radiation and have spaces between them, are placed closer to the radiation source than to the target surface, whereby the reflection and absorption of the transparent plates attenuates the radiation to the desired areas and wherein at least one diffuser is positioned between the radiation source and the transparent plates.

2. The method as according to claim 1, wherein the transparent plates are positioned essentially parallel to the target surface.

3. The method as defined in claim 1 or 2 wherein a flash tube is used as the radiation source and the target surface is a solar panel.

4. A method according to claim 2, wherein the transparent plates are arranged in a conical stack between the radiation source and the target plane.

5. The method according to claim 1, wherein the transparent plate closest to the radiation source is placed from the source at a distance of 5–20%, of the distance between the source and the target.

6. A device for modifying the irradiation distribution of a radiation source, which device comprises a radiation source by means of which radiation can be directed to an essentially planar target surface, wherein between the radiation source and the target surface, several plates, which are essentially transparent to the radiation and have spaces between them, are placed closer to the radiation source than to the target surface, whereby reflection and absorption of the transparent plates attenuates the radiation to the desired areas and wherein at least one diffuser is positioned between the radiation source and the transparent plates.

7. The device as defined in claim 6, wherein the transparent plates are positioned essentially parallel to the target surface.

8. A device according to claim 6 or 7, wherein a flash tube is used as the radiation source and the target surface is a solar panel.

9. The device according to claim 6, wherein the transparent plates are arranged in a conical stack between the radiation source and the target plane.

10. The device according to claim 6, wherein the transparent plate closest to the source is placed from the source at a distance of 5–20%, of the distance between the source and the target.

11. The method according to claim 5, wherein the distance is 10% of the distance between the source and the target.

12. The device according to claim 10, wherein the distance is 10% of the distance between the source and the target.

13. The method according to claim 1, wherein the transparent plates absorb up to 75% of the total radiation.

14. The method according to claim 1, wherein the transparent plates absorb between 5 to 40% of the incident radiation.

* * * * *